United States Patent [19]

Genova et al.

[11] Patent Number: 4,968,320

[45] Date of Patent: Nov. 6, 1990

[54] HYBRID DIESEL FUEL COMPOSITION

[75] Inventors: Calogero Genova, Vizzolo Predabissi; Edoardo Platone, Asti, both of Italy

[73] Assignee: Eniricerche S.p.A., Milan, Italy

[21] Appl. No.: 269,865

[22] Filed: Nov. 10, 1988

[30] Foreign Application Priority Data

Dec. 4, 1987 [IT] Italy ..... 22883 A/87
Feb. 24, 1988 [IT] Italy ..... 19509 A/88

[51] Int. Cl.[5] ..... C10L 1/32
[52] U.S. Cl. ..... 44/411; 44/370
[58] Field of Search ..... 44/57, 66, 51, 53, 56, 44/78

[56] References Cited

U.S. PATENT DOCUMENTS

| | | | |
|---|---|---|---|
| 4,012,329 | 3/1977 | Hayes et al. | 252/8.5 P |
| 4,451,265 | 5/1984 | Schwab | 44/57 |
| 4,451,267 | 5/1984 | Schwab et al. | 44/66 |
| 4,539,104 | 9/1985 | Sweeney | 44/57 |
| 4,585,461 | 4/1986 | Gorman | 44/57 |
| 4,668,247 | 5/1987 | Berenyi | 44/66 |

*Primary Examiner*—Margaret B. Medley
*Attorney, Agent, or Firm*—Hedman, Gibson, Costigan & Hoare

[57] ABSTRACT

A hybrid diesel fuel composition consisting of a conventional diesel fuel, at least one surface-active agent, water, and a consistent proportion of fusel oil.

10 Claims, 1 Drawing Sheet

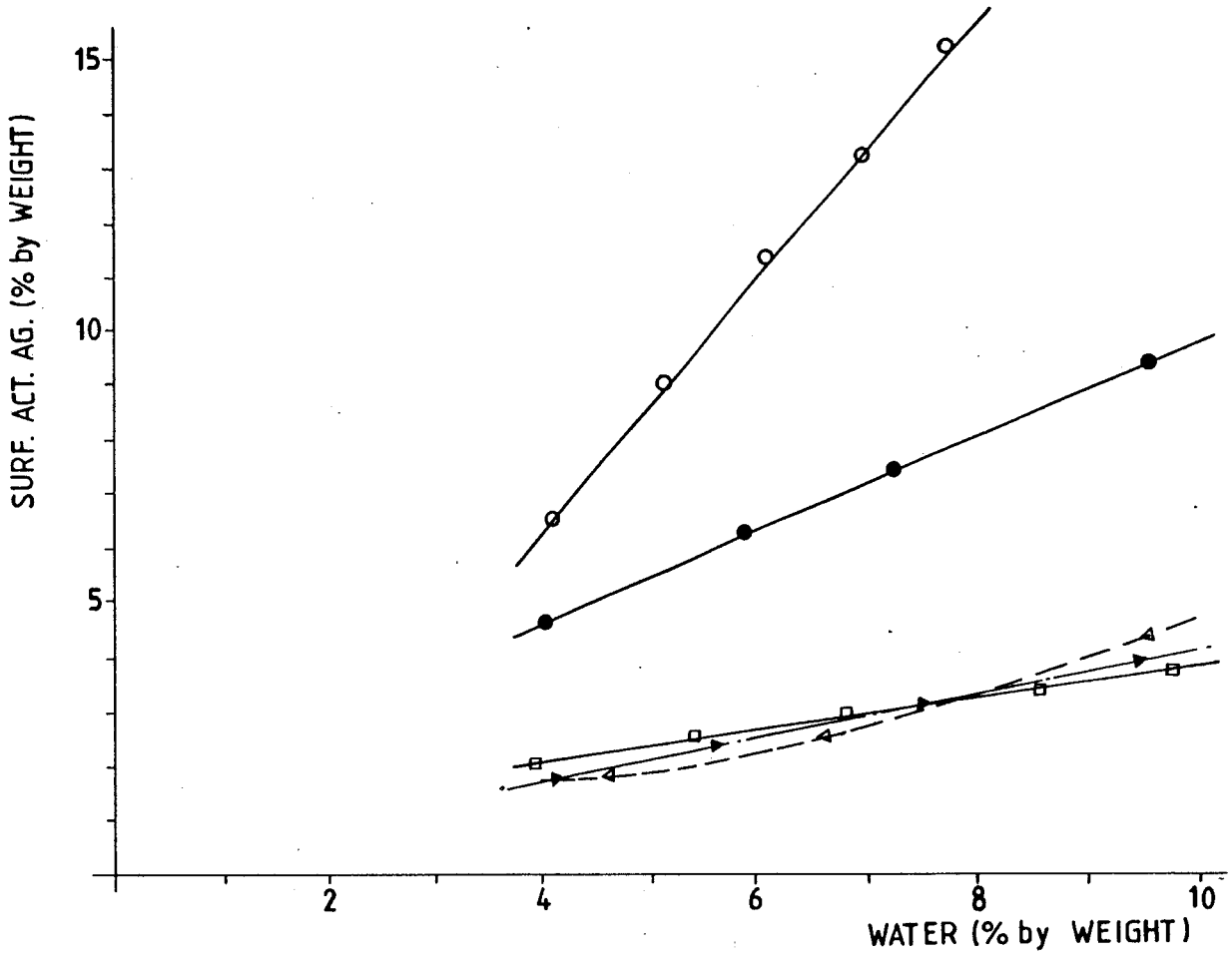
SURF. ACT. AG. (% by WEIGHT)
15
10
5
2
4
6
8
10
WATER (% by WEIGHT)

HYBRID DIESEL FUEL COMPOSITION

BACKGROUND OF THE INVENTION

This invention relates to a hybrid Diesel fuel composition.

It is highly desirable that such hybrid Diesel fuel compositions be stable microemulsions, that is to say, that they may undergo a number of manipulations such as pumping, storage and other like operations with a minimum hazard of splitting of such microemulsions.

In order to overcome economic problems originated by the petroleum product crisis, hybrid Diesel fuel compositions have been suggested recently, which contained a fraction of alcohols, mainly methanol and ethanol.

These additions, however, have created technical problems, mainly connected with the intolerance to water, phase splitting and unsatisfactory rheological properties.

Thus, for example, methanol is inherently insoluble in the Diesel fuels, while ethanol can be blended in any proportions with Diesel fuels, but even tiny amounts of water suffice to bring about phase splitting.

The technical problem at stake was then that of providing hybrid Diesel fuel compositions which were less water-incompatible, on bearing in mind, also, the circumstance that water is a Diesel-fuel improver, in that it lowers the combustion temperature and reduces both the emission of fumes and the formation of nitrogen oxides.

U.S. Pat. No. 4,451,267 has suggested to use a surface-active agent, or a blend of such agents, in order to improve Diesel fuel compositions containing a conventional Diesel fuel, lower alcohols and water.

EP-A- 0 117 915 has suggested not to use surface-active agents, but, rather, to adopt higher alcohols to stabilize blends of conventional Diesel fuel, lower alcohols and water.

These approaches, however, have proven to be not entirely satisfactory because comparatively high amounts of surface-active agents are required to stabilize the emulsions or microemulsions satisfactorily, and, on the other hand, if no surface-active agents are used, the amounts of higher alcohols required are, again, comparatively high and this is an added cost.

With either approach, however, both in the case of homogeneous blends and (micro)emulsions, the water compatibility generally leaves much to be desired in order to achieve a satisfactory combustion with reduced emission of fumes and nitrogen oxides.

SUMMARY OF THE INVENTION

In order to offset the drawbacks of the prior art approaches outlined above, the present invention provides a hybrid Diesel fuel composition containing a Diesel fuel from 69–78.3% by weight, a surface-active agent from 1.6–7% by weight and water from 3.5–10% by weight, the weight percentage of water including the water contained in the fused oil as an impurity, which is characterized in that it further contains fusel oil.

Fusel oil, as is well known, is a by-product of the alcoholic fermentation of starches and sugars and is obtained by the redistillation of the crude ethanol: it is composed chiefly of 3-methyl-1-butanol (isoamyl alcohol) and 2-methyl-1-butanol (levorotatory), together with ethyl, n-propyl and isobutyl alcohols, water, and traces of n-butyl alcohol, 1-pentanol, and hexyl and heptyl alcohols, plus traces of aldehydes, acids, esters, pyridine and sometimes alkaloids.

Fusel oil is usually supplied in a crude and a refined grade: to the purposes of the present invention, crude fusel oil is mainly considered, and this is a significant economic asset as compared with using refined higher alcohols.

A typical fusel oil composition comprises, on a weight basis, 38% of isoamyl alcohol, 25% of isobutyl alcohol, 4.5% of isopropyl alcohol, 13% of ethanol, 0.5% of methanol and other component, plus 19% of water.

Refined fusel oil could be used, of course, but it is not recommendable from an economic standpoint and it is not necessary.

The Diesel fuel composition according to the present invention contains from 14.2% to 19% of fusel oil, on a weight basis.

Among the surface-active agents to be used in the Diesel fuel compositions according to the present invention, anionic surface-active agents are preferred and, more particularly, the alkali metal salts and the alkaline earth metal salts of a carboxylic acid selected from among alkylbenzenesulphonic acids containing from 9 to 15 carbon atoms in the alkyl moiety, and the unsaturated higher fatty acids containing from 15 to 24 carbon atoms.

Preferential examples of these are sodium dodecylbenzenesulphonate, sodium oleate and sodium erucate.

The Diesel fuel composition of this invention has the form of a microemulsion, that is, a colloidal dispersion, which is both transparent and thermodynamically stable: the mean diameter of the dispersed particles is less than one quarter-wavelength of the visible radiations.

Such a microemulsion is thermodynamically stable within a wide range of water content.

A preferred composition is one in which water is, on a weight basis, from 5% to 6%, in order to have a fully satisfactory combustion run.

More particularly, such a preferred composition contains from 74.5% to 76.9% of Diesel fuel, from 15.1% to 15.6% of fusel oil, from 1.5% to 4.4% of surface-active agent, and from 5% to 6% of water.

The selection of the surface-active agent is not particularly critical in this aspect of the invention.

The most preferred Diesel fuel is Diesel Fuel No. 2 according to the ASTM-Standards.

Thus, the economic advantage of using a cheap by product such as fusel oil is combined with that of using conventional anionic surface-active agents, which are readily available commercially.

Conventional additives, such as cetane number improvers, corrosion inhibitors, metal deactivators and antioxidants can be used in the Diesel fuel compositions contemplated herein: generally, they represent about 1% on the overall weight of the composition.

The percentage compositions in this specification and claims are intended on an anhydrous weight basis, and the water content includes the water which is contained in the fusel oil as an impurity.

A practical advantage of the Diesel fuel compositions of the present invention is that they can be conveniently prepared and the microemulsion is formed spontaneously by merely homogeneizing the several components thereof.

Any emulsion-preparing procedure can be adopted: thus, it is possible to add to the Diesel fuel a blend of fusel oil, surface-active agent and water, or, as an alternative, Diesel fuel and fusel oil can be pre-blended, whereafter the surface-active agent and the water are added sequentially with a not too vigorous stirring.

BRIEF DESCRIPTION OF THE DRAWING

The invention will be illustrated by a few examples, aided by the single FIGURE of the accompanying drawing, which is a plot reporting the concentration of certain surface-active agents and the corresponding concentration of water in the composition, which produce a thermodynamically stable composition.

DESCRIPTION OF THE PREFERRED EMBODIMENT(S)

In the ensuing Examples from 1 to 3, a Diesel Fuel No. 2, by AGIP PETROLI S.p.A. has been used, together with a crude fusel oil containing, on a weight basis: 38% of isoamyl alcohol, 25% of isobutyl alcohol, 4.5% of isopropyl alcohol, 13% of ethanol, 0.5% of methanol and others, and 19% of water.

The blend has been prepared by blending the Diesel fuel and the fusel oil in a weight ratio of 4:1, whereafter the surface-active agent has been added in variable amounts until obtaining a clear solution and water has been added eventually.

EXAMPLE 1

The following microemulsions have been prepared, and sodium dodecylbenzenesulphonate was the surface-active agent adopted.

| | Diesel fuel | Fusel oil | Surf. act. ag. | Water |
|---|---|---|---|---|
| (1) | 69.8 | 14.2 | 7.0 | 9.0 |
| (2) | 73.0 | 14.8 | 5.2 | 7.0 |
| (3) | 75.8 | 15.4 | 3.8 | 5.0 |
| (4) | 77.3 | 15.7 | 3.0 | 4.0 |

EXAMPLE 2

With the same procedure as in Example 1, the following compositions have been prepared, using sodium oleate as the surface-active agent.

| | Diesel fuel | Fusel oil | Surf. act. ag. | Water |
|---|---|---|---|---|
| (5) | 72.3 | 14.7 | 4.0 | 9.0 |
| (6) | 75.0 | 15.2 | 2.8 | 7.0 |
| (7) | 77.3 | 15.7 | 2.0 | 5.0 |
| (8) | 78.3 | 15.9 | 1.8 | 4.0 |

EXAMPLE 3

The following compositions have been prepared, in the form of microemulsions, using sodium erucate as the surface-active agent.

| | Diesel fuel | Fusel oil | Surf. act. ag. | Water |
|---|---|---|---|---|
| (9) | 73.8 | 15.0 | 2.2 | 9.0 |
| (10) | 74.8 | 15.2 | 2.0 | 8.0 |
| (11) | 76.0 | 15.4 | 1.6 | 7.0 |
| (12) | 76.9 | 15.6 | 1.5 | 6.0 |

All the compositions reported in the previous Examples have proven to be stable, since they did not show any symptoms of settling or emulsion splitting after a 3-month storage, both at room temperature (20° C.–25° C.) and at temperatures in the neighbourhood of 0° C.

A further aspect of the present invention relates to the use of the surface-active agents, in that it has been ascertained that the alkali metal salts of the higher fatty acids, more particularly the sodium salts, though quite satisfactory under the respect of their use at low concentrations, exhibit the shortcoming of forming incrustations in the engine combustion chambers.

On the other hand, the alkaline earth metal salts of the fatty acids aforementioned do not exhibit the incrustation drawback, but should be used in higher concentrations: in addition, such magnesium salts are poorly soluble in an aqueous environment.

It has been further ascertained, therefore, that, by using an appropriate combination of the sodium and the magnesium salt of a higher unsaturated fatty acid, thermodynamically stable microemulsions can be obtained, which do not exhibit the incrustation defect.

Moreover, it has been found that optimum results can be obtained if the weight ratio of the unsaturated higher fatty acid sodium salt to the unsaturated higher fatty acid magnesium salt is comprised between 90:10 and 40:60.

A preferred composition prepared according to this principle contains, still on a weight basis, from 69% to 75.5% of a conventional Diesel fuel, from 17% to 19% of fusel oil, from 3.5% to 10% of water, and from 2% to 4% of a mixture of sodium and magnesium salts of unsaturated higher fatty acids containing from 16 to 24 carbon atoms, in the weight ratio of the former to the latter of from 90:10 to 40:60.

As hereinbefore, the percentage of fusel oil is reckoned on an anhydrous weight basis, and the precentage of water includes the water contained in the fusel oil as an impurity.

The Diesel fuel is any conventional fuel and ASTM No. 2 is preferred, as it is the most widely used for commercial and agricultural vehicles.

As outlined hereinbefore, raw fusel oil can safely be used, with economical and practical advantage.

The preferred weight ratio of the sodium salt to the magnesium salt is comprised between 60:40 and 30:70 and still more preferred is a blend of sodium salt and magnesium salt in the weight proportions of 50:50, which gives the best desirable results in terms of microemulsion formation and reduction of the incrustation phenomena.

Therefore, a preferred suggested composition contains, on a weight basis, 73.1% of Diesel fuel, 18.3% of fusel oil, 6% of water and 2.6% of a surface-active agent consisting of a 50:50 by weight blend of sodium and magnesium salt of a higher unsaturated fatty acid having from 16 to 24 carbon atoms.

Compositions have been prepared, using the same Diesel fuel and the same fusel oil as used for Examples 1 to 3 hereof, to prepare the compositions of the ensuing Examples 4 to 8, and the blending procedure is the same as outlined hereinabove.

EXAMPLE 4 (REFERENCE EXAMPLE)

A blend of Diesel fuel and fusel oil is prepared, the weight ratio of the former to the latter being 4:1.

The concentration of surface-active agent, which is magnesium oleate, and the corresponding concentration of water which produce a thermodynamically stable microemulsion are reported in the plot marked — in the single Figure of the drawing.

In the plot, the ordinate is the concentration, in percent by weight, of the surface-active agent, and the abscissa is the concentration of water, also in percentage by weight.

EXAMPLE 5 (REFERENCE EXAMPLE)

As in Example 4, but the surface-active agent is a 30:70 blend, on a weight basis, of sodium oleate and magnesium oleate.

The results are plotted in the plot — of the single Figure of the drawing.

EXAMPLE 6

The procedure is that of Example 4, and the surface-active agent, here, is a 50:50 by weight blend of sodium oleate and magenesium oleate.

The results are displayed by the plot marked □—□ in the single Figure of the drawing.

EXAMPLE 7

The procedure is that of Example 4 again, and the surface-active agent is a 70:30 by weight blend of sodium oleate and magnesium oleate.

The results are displayed by the plot marked — in the drawing.

EXAMPLE 8 (REFERENCE EXAMPLE)

Using the procedure of Example 4 once again, the surface-active agent is sodium oleate alone.

The results are shown by the plot — on the drawing.

The criticality of the weight ratio of the sodium salt to the magnesium salt of a higher unsaturated fatty acid as defined above is demonstrated.

We claim:

1. A hybrid diesel fuel composition comprising:
(a) 69% to 78.3% by weight of diesel fuel;
(b) 14.2% to 19% by weight of fusel oil;
(c) 1.6% to 7.0% by weight of a surface-active agent, wherein the surface-active agent is an alkali metal salt or alkaline earth metal salt of a carboxylic acid selected from among alkylbenzenesulfonic acids containing from 9 to 15 carbon atoms in the alkyl moiety and unsaturated higher fatty acids containing from 15 to 24 carbon atoms; and
(d) 3.5% to 10% by weight of water, on an anhydrous weight basis, the weight percentage of water including the water contained in the fusel oil as an impurity.

2. The diesel fuel composition according to claim 1, wherein the composition comprises:
(a) 69.8% to 78.3% by weight of the diesel fuel;
(b) 14.2% to 15.9% by weight of the fusel oil;
(c) 1.6% to 7.0% by weight of the surface-active agent; and
(d) 4.0% to 9.0% by weight of the water.

3. The diesel fuel composition according to claim 1, wherein the composition comprises:
(a) 74.5% to 76.9% by weight of the diesel fuel;
(b) 15.1% to 15.6% by weight of fusel oil;
(c) 1.5% to 4.4% by weight of the surface-active agent; and
(d) 5% to 6% by weight of the water.

4. The diesel fuel composition according to claim 1, wherein the diesel fuel is ASTM Diesel Fuel No. 2.

5. The diesel fuel composition according to claim 1, wherein the surface-active agent is selected from the group consisting of: sodium dodecylbenzenesulfonate, sodium oleate and sodium erucate.

6. The diesel fuel composition according to claim 1, wherein the surface-active agent is a blend of the sodium salt of an unsaturated higher fatty acid with the magnesium salt of an unsaturated higher fatty, the weight ratio of the sodium salt to the magnesium salt being from 90:10 to 40:60.

7. The diesel fuel composition according to claim 1, wherein the composition comprises:
(a) 69% to 75.5% by weight of the diesel fuel;
(b) 17% to 19% by weight of the fusel oil;
(c) 3.5% to 10% by weight of the water; and
(d) 2% to 4% by weight of the surface-active agent, wherein the surface-active agent is a blend of the sodium salt of an unsaturated higher fatty acid having from 16 to 24 carbon atoms with the magnesium salt of an unsaturated higher fatty acid having from 16 to 24 carbon atoms, the weight ratio of the sodium salt to the magnesium salt in the blend being from 90:10 to 40:60.

8. The diesel fuel composition according to claim 7, wherein the weight ratio of the sodium salt to the magnesium salt is from 60:40 to 30:70.

9. The diesel fuel composition according to claim 7, wherein the weight ratio of the sodium salt to the magnesium salt is 50:50.

10. The diesel fuel composition according to claim 1, further comprising a diesel fuel additive selected from the group consisting of: cetane number improvers, corrosion inhibitors, metal deactivators, and antioxidants.

* * * * *